US009335055B2

(12) United States Patent
Chilton et al.

(10) Patent No.: US 9,335,055 B2
(45) Date of Patent: May 10, 2016

(54) OVEN APPLIANCE

(71) Applicant: General Electric Company, Schenectady, NY (US)

(72) Inventors: John Mark Chilton, Campbellsburg, KY (US); Stephen Bernard Froelicher, Shepherdsville, KY (US); Scott Thomas Kershner, La Grange, KY (US); Joshua Stephen Wiseman, Elizabethtown, KY (US); John Adam Yantis, Prospect, KY (US)

(73) Assignee: General Electric Company, Schenectady, NY (US)

( * ) Notice: Subject to any disclaimer, the term of this patent is extended or adjusted under 35 U.S.C. 154(b) by 393 days.

(21) Appl. No.: 13/790,146

(22) Filed: Mar. 8, 2013

(65) Prior Publication Data

US 2014/0251301 A1 Sep. 11, 2014

(51) Int. Cl.
*F24C 15/02* (2006.01)

(52) U.S. Cl.
CPC ..... *F24C 15/02* (2013.01)

(58) Field of Classification Search
CPC ..... A21B 3/02; F24C 15/02; F24C 15/021; F25D 2323/021; E06B 3/76; E06B 3/6715; E06B 3/26336; E05F 17/004
USPC ..... 126/190, 193, 198; 312/326; 49/366, 49/DIG. 1
See application file for complete search history.

(56) References Cited

U.S. PATENT DOCUMENTS 1,801,564 A * 4/1931 Muffly ..... F25D 23/082 105/423
1,885,357 A * 11/1932 Kirby ..... F24C 15/02 126/190
2,692,809 A * 10/1954 Kesling ..... F25D 23/02 312/296
2,708,709 A * 5/1955 Pearce ..... F24C 15/022 126/190
2,723,896 A * 11/1955 Wurtz ..... E05C 19/161 160/DIG. 16
2,767,040 A * 10/1956 Kesling ..... F25D 23/087 312/296
2,811,406 A * 10/1957 Moore ..... F25D 23/082 219/218
2,823,664 A * 2/1958 Evans et al. ..... 126/198
2,860,026 A * 11/1958 Long ..... 312/296
2,889,825 A * 6/1959 Evans ..... 126/198
2,965,095 A * 12/1960 Pearce et al. ..... 126/21 R
3,045,663 A * 7/1962 McDonnold ..... F24C 15/023 126/190
3,189,019 A * 6/1965 Pearce ..... F24C 15/02 126/190

(Continued)

*Primary Examiner* — Jorge Pereiro
(74) *Attorney, Agent, or Firm* — Dority & Manning, P.A.

(57) ABSTRACT

An oven appliance is provided. The oven appliance includes a pair of doors. Each door of the pair of doors includes an outer door panel and an inner door panel. The outer and inner door panels are spaced apart from each other along at least one edge of the door such that the inner and outer door panels define a thermal break therebetween. The thermal break can assist with limiting or hindering heat transfer between the inner and outer door panels.

14 Claims, 6 Drawing Sheets

(56) References Cited

U.S. PATENT DOCUMENTS 3,216,776 A * 11/1965 Carbary ..... 312/296
3,335,524 A * 8/1967 Carson ..... 49/501
3,693,494 A * 9/1972 Meyer ..... F16B 21/086 411/508
3,996,710 A * 12/1976 Nuss ..... 52/202
4,053,972 A * 10/1977 Kordes ..... 29/423
4,288,135 A * 9/1981 Buchser ..... F25D 23/028 312/296
4,545,607 A * 10/1985 Yulkowski ..... E05C 3/24 292/210
4,589,240 A * 5/1986 Kendall ..... E04C 2/292 49/501
4,648,766 A * 3/1987 Wollar ..... F16B 19/1081 411/41
4,663,204 A * 5/1987 Langham ..... B32B 3/30 428/12
4,930,257 A * 6/1990 Windgassen ..... 49/504
5,349,782 A * 9/1994 Yulkowski ..... E05C 19/002 49/366
5,417,029 A * 5/1995 Hugus et al. ..... 52/792.1
6,079,403 A * 6/2000 Binder ..... 126/190
6,905,332 B1 * 6/2005 Neal et al. ..... 432/247
6,974,383 B2 * 12/2005 Lewis et al. ..... 454/338
7,814,897 B2 * 10/2010 Larsen ..... 126/191
8,516,756 B2 * 8/2013 Thielmann ..... 52/208
8,689,781 B1 * 4/2014 Chilton et al. ..... 126/192
8,944,536 B2 * 2/2015 Yantis et al. ..... 312/324
2004/0149757 A1 * 8/2004 Lewis et al. ..... 220/345.2
2007/0246036 A1 10/2007 Larsen et al.
2010/0269450 A1 10/2010 Thielmann
2014/0069409 A1 * 3/2014 Yantis et al. ..... 126/198
2014/0070681 A1 * 3/2014 Yantis et al. ..... 312/236

* cited by examiner

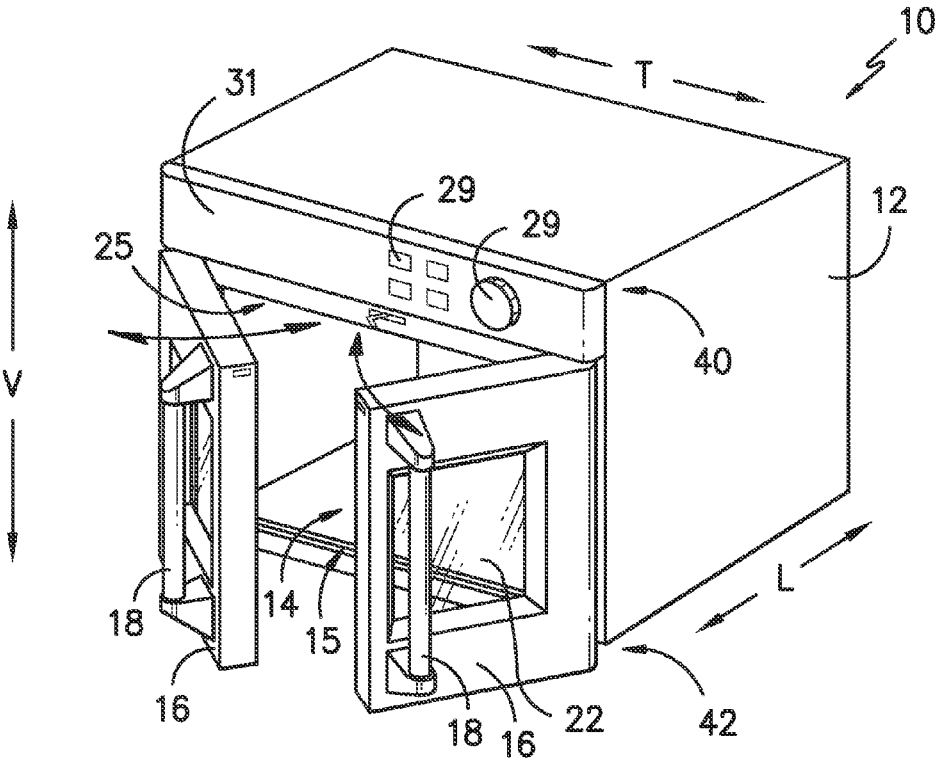
FIG. —1—
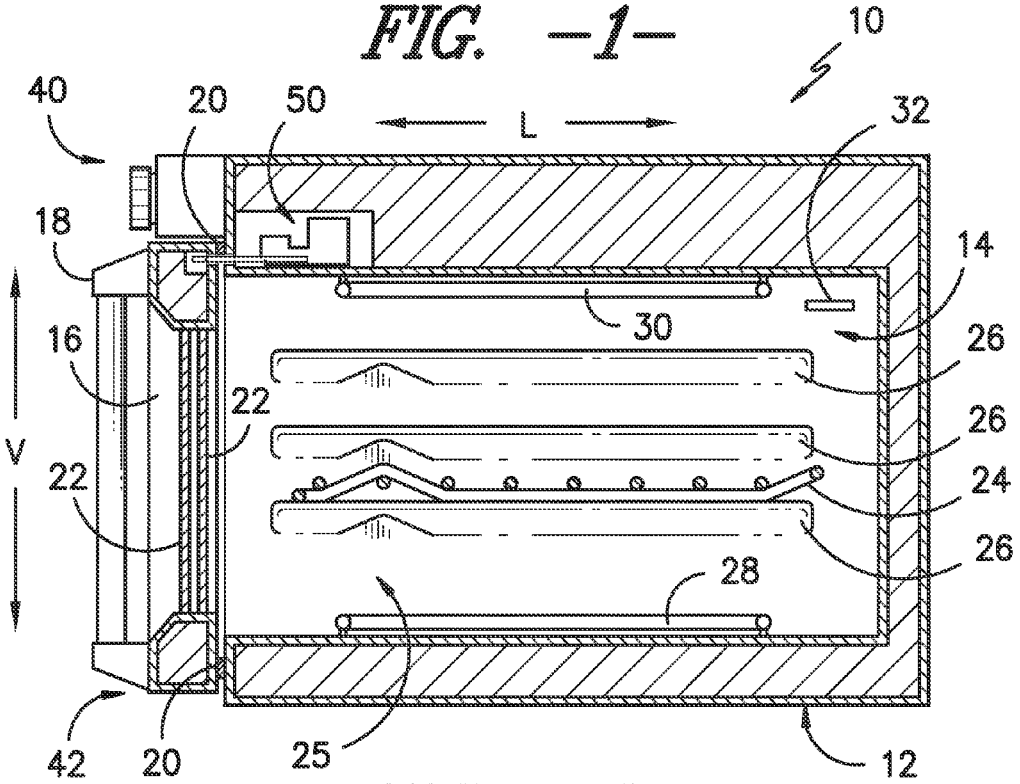
FIG. —2—

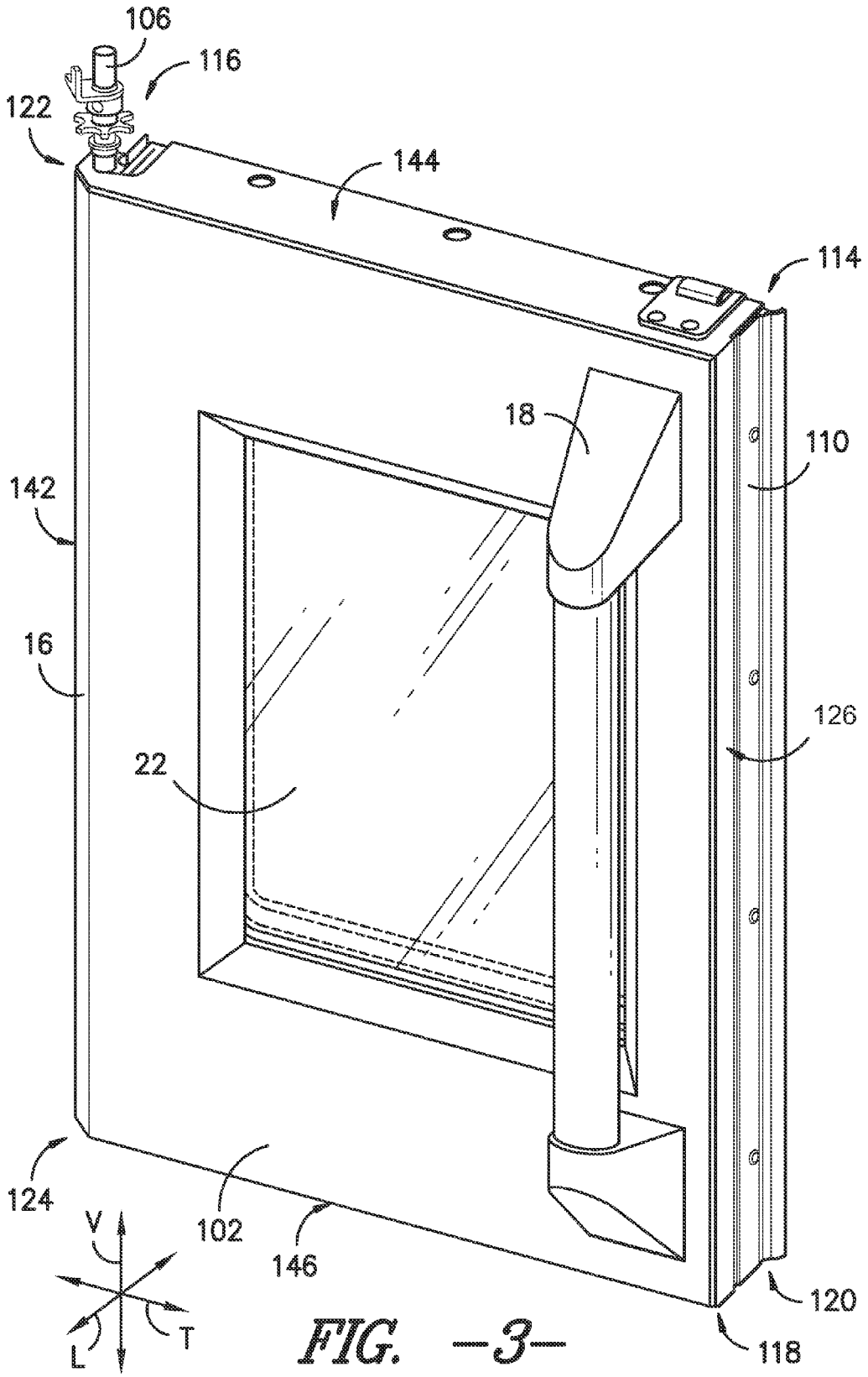
FIG. —3—

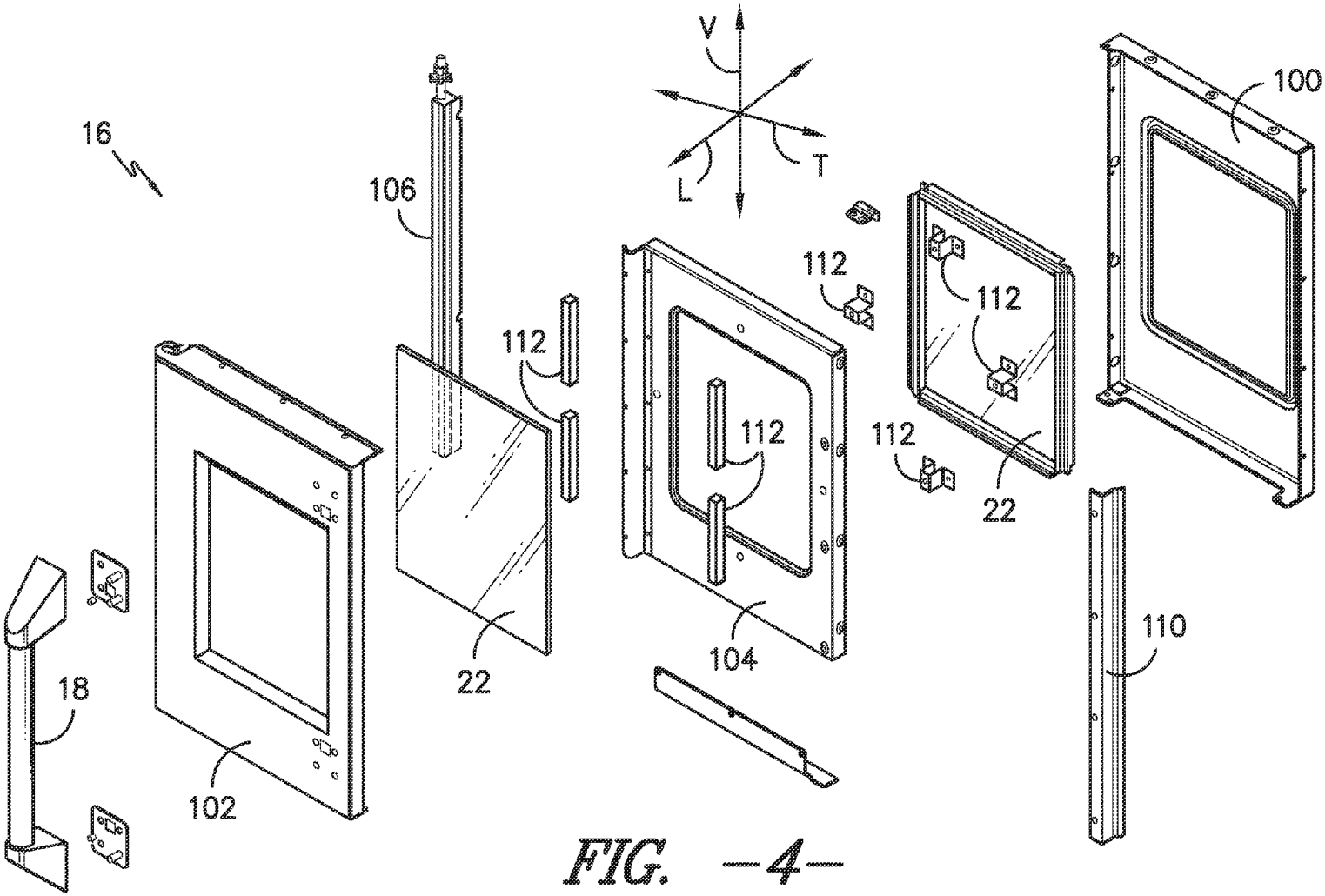
FIG. —4—

OVEN APPLIANCE

FIELD OF THE INVENTION

The present subject matter relates generally to oven appliances, such as French door oven appliances.

BACKGROUND OF THE INVENTION

Oven appliances generally include a cabinet that defines a cooking chamber for receipt of food articles for cooking. The cabinet can also define an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

During certain oven operations or cycles, e.g., a cleaning cycle, the cooking chamber can reach high temperatures. Such high temperatures can heat oven appliance components and potentially injure a person touching such components. In order to reduce the risk of potential injury, the oven appliance's door(s) and other outer surfaces preferably remains below a certain temperature threshold during such cycles.

However, limiting heat transfer between inner and outer surfaces of French door style oven appliances can be difficult. In particular, inner and outer surfaces of the doors are generally connected to each other such that conduction between the inner and outer surfaces can cause the outer surface to reach an unacceptable temperature during certain oven appliance operations. Further, a gap between the oven appliance's doors generally falls inside a gasket seal of the oven appliance and is directly exposed to heated air from the cooking chamber. In turn, such heated air can transfer heat to the oven appliance's outer surface.

Accordingly, an oven appliance with features for limiting or hindering heat transfer to an outer surface of doors of the oven appliance would be useful. In particular, an oven appliance with features for preventing or hindering an outer surface of doors of the oven appliance from overheating would be useful.

BRIEF DESCRIPTION OF THE INVENTION

The present subject matter provides an oven appliance. The oven appliance includes a pair of doors. Each door of the pair of doors includes an outer door panel and an inner door panel. The outer and inner door panels are spaced apart from each other along at least one edge of the door such that the inner and outer door panels define a thermal break therebetween. The thermal break can assist with limiting or hindering heat transfer between the inner and outer door panels. Additional aspects and advantages of the invention will be set forth in part in the following description, or may be apparent from the description, or may be learned through practice of the invention.

In a first exemplary embodiment, an oven appliance is provided. The oven appliance defines a lateral direction. The oven appliance includes a cabinet that defines a cooking chamber for receipt of food items for cooking and an opening that permits access to the cooking chamber of the cabinet. The oven appliance also includes a pair of doors mounted to the cabinet at the opening of the cabinet. Each door of the pair of doors includes an outer door panel and an inner door panel. The inner door panel is spaced apart from the outer door panel in the lateral direction along at least one edge of the door such that the inner and outer door panels define a thermal break along the at least one edge.

In a second exemplary embodiment, an oven appliance is provided. The oven appliance defines a lateral direction. The oven appliance includes a cabinet that defines a cooking chamber for receipt of food items for cooking and an opening for accessing the cooking chamber of the cabinet. A pair of doors is mounted to the cabinet at the opening of the cabinet. Each door of the pair of doors has a vertically-oriented edge where the doors of the pair of doors meet when the doors of the pair of doors are in a closed position, each of said doors having an inner door panel and an outer door panel. The inner door panel is spaced apart from the outer door panel at the vertically-oriented edge so as to define a thermal break therebetween.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a front, perspective view of an oven appliance according to an exemplary embodiment of the present subject matter.

FIG. 2 provides a side, section view of the oven appliance of FIG. 1.

FIG. 3 provides a front, perspective view of a door of the oven appliance of FIG. 1.

FIG. 4 provides an exploded view of the door of FIG. 3.

DETAILED DESCRIPTION

Figure 5:
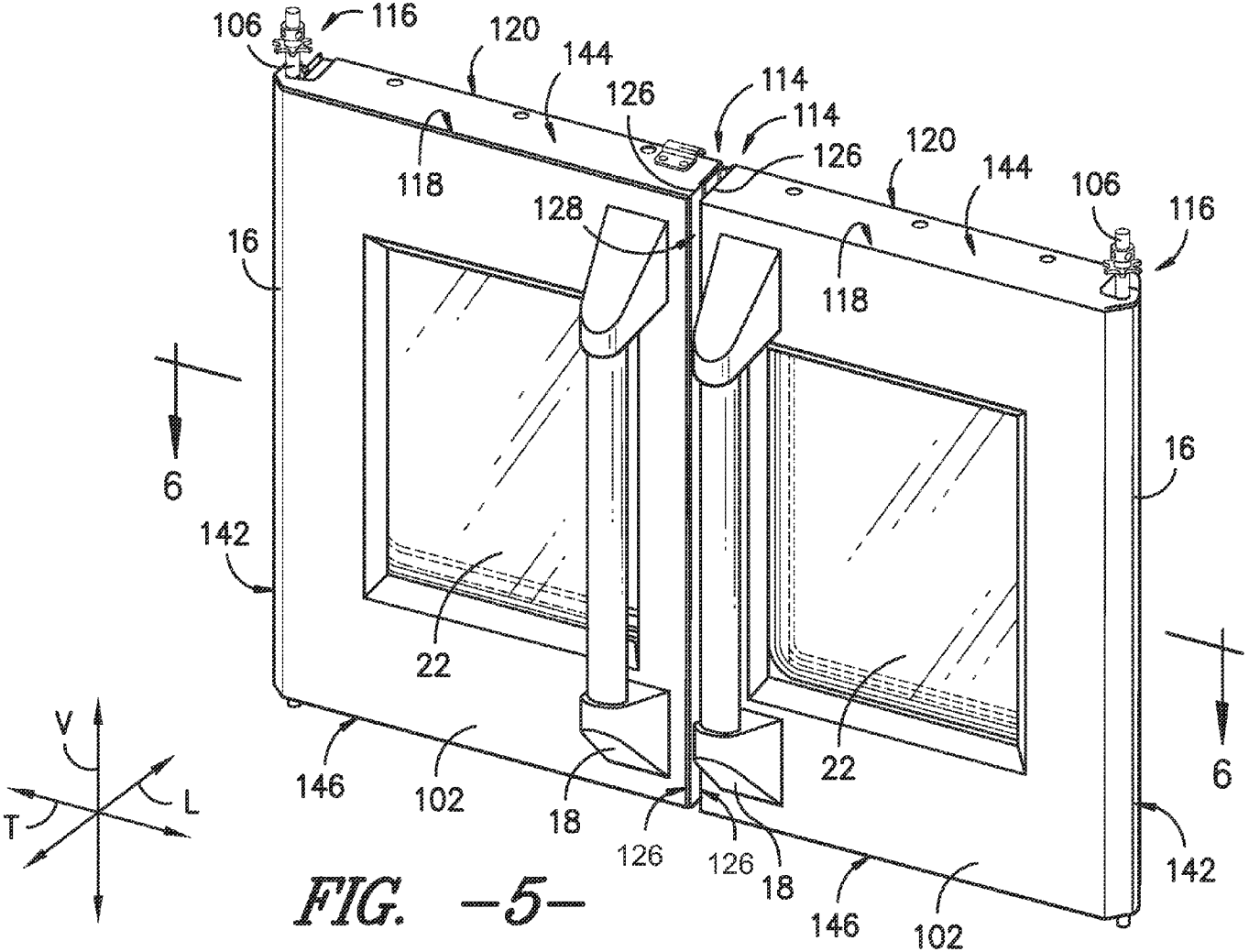
FIG. 5 provides a front, perspective view of a pair of doors of the oven appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an oven appliance 10 according to an exemplary embodiment of the present subject matter. Oven appliance 10 includes an insulated cabinet 12 with an interior surface 25 that defines a cooking chamber 14. Cooking chamber 14 is configured for the receipt of one or more food items to be cooked.

Cabinet 12 extends between a top 40 and a bottom 42 along a vertical direction V. Cabinet 12 also defines a lateral direction L and a transverse direction T. The vertical, lateral, and transverse directions V, L, and T are mutually perpendicular and form an orthogonal direction system.

Oven appliance 10 also includes a pair of doors 16 rotatably mounted on cabinet 12 proximate an opening 15 to chamber 14 defined by cabinet 12. Thus, oven appliance 10 is sometimes referred to as a French door style oven appliance. Doors 16 are configured for selectively shifting between an open position or configuration shown in FIG. 1 in which a user can access cooking chamber 14 and a closed position or configuration shown in FIG. 2 in which the user is impeded from accessing cooking chamber 14 by doors 16. Handles 18 are attached to doors 16 and assist with shifting doors 16 between the open and closed positions.

One or more gaskets 20 between doors 16 and cabinet 12 provide for maintaining heat and cooking fumes within chamber 14 when doors 16 are in the closed position as shown in FIG. 2. Glass panes 22 provide for viewing the contents of chamber 14 when doors 16 are in the closed position as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16 are open. Multiple rails 26 are provided so that the height of rack 24 may be adjusted.

Heating elements 28 and 30 are positioned within chamber 14 of cabinet 12. Heating elements 28 and 30 are used to heat chamber 14 for both cooking and cleaning of oven appliance 10. While electrically-resistive heating elements 28 and 30 are shown, the present subject matter may be used with other heating elements as well, such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors can be placed within oven appliance 10 for determining the oven temperature.

Oven appliance 10 is provided by way of example only. Thus, the present subject matter may be used in any other suitable oven appliance configuration. For example, the present subject matter may be used in oven range appliances or in oven appliances that define multiple interior cavities for the receipt of food and/or have different pan or rack arrangements than the exemplary embodiment shown in FIG. 2. Heating elements at the top, back, or sides of chamber 14 may also be provided, and a variety of different types of heating elements such as microwave, halogen, gas fuel, electrical resistance, and combinations thereof may be used. Other configurations may also be used as will be understood by one of skill in the art using the teachings disclosed herein.

As may be seen in FIG. 2, oven appliance 10 includes a lock assembly 50. Lock assembly 50 is configured for selectively securing doors 16 in the closed position. For example, during a cleaning cycle of oven appliance 10, cooking chamber 14 and heating elements 28, 30 can reach high temperatures. Lock assembly 50 may secure doors 16 in the closed position during the cleaning cycle, e.g., in order to prevent the user from opening doors 16 and accessing cooking chamber 14.

As will be understood by those skilled in the art, cooking chamber 14 can reach high temperatures, e.g., between about eight hundred degrees Fahrenheit and about one thousand degrees Fahrenheit, during certain oven appliance operations or cycles, such as the cleaning cycle. Further, heat transfer between cooking chamber 14 and doors 16 can heat doors 16 during such cycles. Thus, as discussed in greater detail below, oven appliance 10 includes features for assisting with cooling doors 16, e.g., to hinder or prevent potential injuries to a user of oven appliance 10 due to overheating of doors 16 during such cycles.

FIG. 3 provides a perspective view of one of doors 16 of oven appliance 10 (FIG. 1). FIG. 4 provides an exploded view of the one of doors 16. As may be seen in FIG. 3, door 16 extends between a first side portion 114 and a second side portion 116, e.g., along the transverse direction T. Thus, first and second side portions 114 and 116 can be spaced apart from each other along the transverse direction T and positioned on opposite transverse sides of door 16. Door 16 also extends between an exterior portion 118 and an interior portion 120, e.g., along the lateral direction L. Thus, exterior and interior portions 118 and 120 can be spaced apart from each other along the lateral direction L and positioned on opposite lateral sides of door 16. Door 16 further extends between a top portion 122 and a bottom portion 124, e.g., along the vertical direction V. Thus, top and bottom portions 122 and 124 can be spaced apart from each other along the vertical direction V and positioned on opposite vertical sides of door 16. Door 16 also includes a second side edge 142, e.g., positioned at second side portion 116 of door 16, a top edge 144, e.g., positioned at top portion 122 of door 16, and a bottom edge 146, e.g., positioned at bottom portion 124 of door 16.

As may be seen in FIG. 4, door 16 includes an outer door panel 102, e.g., positioned at exterior portion 118 (FIG. 3) of door 16, and an inner door panel 100, e.g., positioned at interior portion 120 (FIG. 3) of door 16. Inner door panel 100 is spaced apart from outer door panel 102, e.g., in the lateral direction L, as discussed in greater detail below. Door 16 also includes insulation 104 disposed between inner and outer door panels 100 and 102, e.g., along the lateral direction L. Insulation 104 can assist with hindering or limiting heat transfer between inner and outer door panels 100 and 102. Door 16 also includes a hinge 106 positioned at second side portion 116 of door 16. Hinge 106 is configured for rotatably mounting door 16 to cabinet 12 (FIG. 1). Door 16 further includes spacers 112 for assisting with arranging or spacing inner door panel 100, outer door panel 102, insulation 104, and/or glass panes 22 relative to one another, e.g., in the lateral direction L.

FIG. 5 provides a perspective view of doors 16 of oven appliance 10 (FIG. 1). As may be seen in FIG. 5, each door of doors 16 has a vertically-oriented edge 126, e.g., positioned at first side portions 114 of doors 16 such that hinge 106 of each door 16 is spaced apart from vertically-oriented edge 126 of each door 16 and positioned on opposite transverse sides of door 16. Vertically-oriented edges 126 define a gap 128 therebetween, e.g., when doors 16 are in the closed position as shown in FIG. 5.

As will be understood by those skilled in the art, interior portions 120, e.g., inner door panel 100, of doors 16 can be exposed to heated air within cooking chamber 14 and radiant energy from heating elements 28 and 30 during operation of oven appliance 10. Thus, inner portions 120 of doors 16 can heat up during operation of oven appliance 10. In order to hinder overheating of doors 16, doors 16 include features for hindering, e.g., conductive, heat transfer between inner and outer door panels 100 and 102 as discussed in greater detail below. Further, heated air can escape cooking chamber 14 through gap 128 between doors 16. Such escaping heated air can negatively affect performance of oven appliance 10 and can also heat exterior portion 118 of doors 16, e.g., adjacent gap 128. Thus, doors 16 include features for hindering or limiting a flow of heated air from cooking chamber 14 through gap 128.

Figure 6:
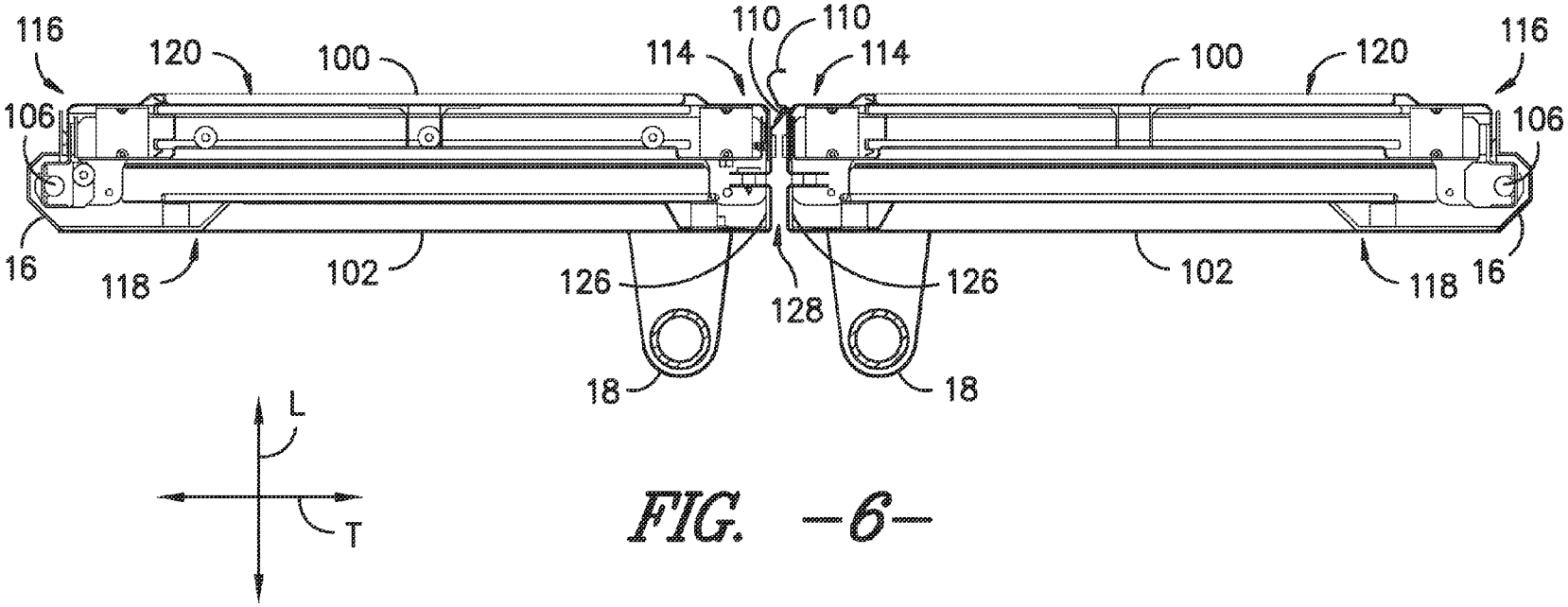
FIG. 6 provides a section view of the doors of FIG. 5 taken along the 6-6 line of FIG. 5.
Figure 7:
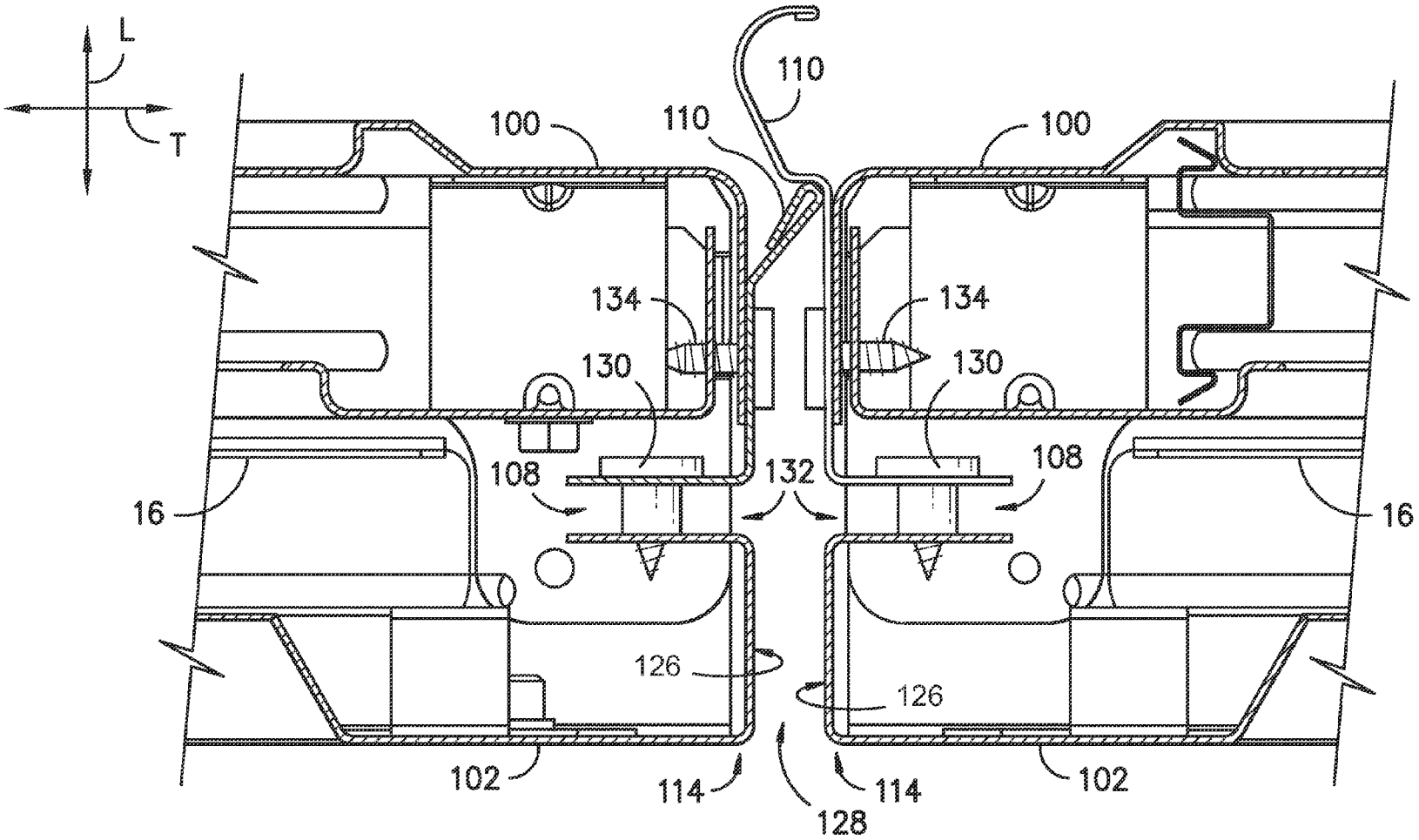
FIG. 7 provides a partial section view of the doors of FIG. 6.

FIG. 6 provides a section view of doors 16 taken along the 6-6 line of FIG. 5. FIG. 7 provides a partial section view of doors 16. As discussed above and as may be seen in FIGS. 6 and 7, inner and outer door panels 100 and 102 are spaced apart from each other, e.g., along the lateral direction L. Inner door panel 100 can be spaced apart from outer door panel 102 along at least one edge of door 16 such that inner and outer door panels 100 and 102 define a thermal break 108 therebetween. In particular, inner and outer door panels 100 and 102 can be spaced apart from each other such that inner and outer door panels 100 and 102 do not touch each other, e.g., at vertically-oriented edge 126 of door 16. Thus, thermal break 108 can correspond to a gap, space, cavity, or other opening between inner and outer door panels 100 and 102 that, e.g., hinders conductive heat transfer therebetween.

Inner and outer door panels 100 and 102 can be constructed with any suitable material. For example, inner door panel 100 may be constructed with a metal, such as enameled steel. Conversely, outer door panel 102 may be constructed with stainless steel. As will be understood by those skilled in the art, metal can be an excellent conductor of thermal energy. By spacing inner and outer door panels 100 and 102 apart and providing thermal break 108, conductive heat transfer between inner and outer door panels 100 and 102 can be limited or hindered despite inner and outer door panels 100 and 102 both being constructed of a thermally conductive material. In such a manner, outer door panel 102 can be hindered or prevented from overheating during oven appliance operations, such as cleaning operations, during which cooking chamber 14 and/or inner door panel 100 can be heated to relatively high temperatures. In alternative exemplary embodiments, outer door panel 102 may be constructed with glass to assist with limiting heat transfer between inner and outer door panels 100 and 102.

As may be seen in FIGS. 6 and 7, oven appliance 10 includes a pair of flanges 110. Each flange of flanges 110 is mounted to a respective one of doors 16, e.g., at vertically-oriented edges 126 of doors 16. Flanges 110 extend into gap 128 and, e.g., hinder heated air from escaping cooking chamber 14. In particular, flanges 110 engage each other when doors 16 are in a closed position and are positioned within gap 128.

As may be seen in FIG. 7, each flange of flanges 110 can be mounted to a respective inner door panel 100 of doors 16, e.g., with fastening mechanisms 134, such as screws, bolts, pins, etc. Further, oven appliance 10 can include a plurality of fasteners 130, such as screws, bolts, pins, etc. Fasteners 130 can couple each flange of flanges 110 to a respective outer door panel 102 of doors 16. However, each flange of flanges 110 can be spaced apart from the respective outer door panel 102, e.g., along the lateral direction L such that flanges 110 do not touch outer door panels 102.

Fasteners 130 can include a grommet, washer, spacer, or other spacing mechanism for maintaining inner and outer door panels 100 and 102 in a spaced apart relationship. Such spacing mechanism of fasteners 130 can be constructed with a first material, such as a ceramic or silicon. Conversely, inner and/or outer door panels 100 and 102 may be constructed with a second material, such as a metal. The first material can have a thermal conductivity less than that of the second material. In such a manner, inner and outer door panels 100 and 102 can be coupled together despite being spaced apart and conductive heat transfer between inner and outer door panels 100 and 102 can be limited or hindered.

Each door of doors 16 can also define an inlet 132 between inner door panel 100 and outer door panel 102, e.g., at vertically-oriented edge 126 and/or first side portion 114 of door 16. The inlets 132 are configured for directing air from gap 128 into thermal breaks 108 of doors 16. As will be understood by those skilled in the art, air within gap 128 can be relatively cool. Thus, a fan or other air handler (not shown) within oven appliance 10 can create a negative pressure within thermal break 108 in order to draw air from gap 128 through inlet 132 into thermal break 108. Such relatively cool air can assist with cooling door 16, e.g., inner and outer door panels 100 and 102, in order to prevent over heating of door 16.

In the exemplary embodiment shown in FIG. 5, inner and outer door panels 100 and 102 are mounted to each other at top portion 122, bottom portion 124, and second side portion 116 of door 16 such that inner and outer door panels 100 and 102 touch each other at such locations. However, in alternative exemplary embodiments, doors 16 can be constructed such that inner and outer door panels 100 and 102 do not touch each other at any suitable combination of first side portion 114, second side portion 116, top portion 122, and bottom portion 124 of door 16. Thus, door 16 can be constructed such that thermal breaks 108 are defined between inner and outer door panels 100 and 102 at any suitable combination of vertically-oriented edge 126, second side edge 142, top edge 144, and bottom edge 146 of doors 16. Accordingly, the exemplary embodiment of doors 16 provided in FIG. 5 with the thermal break 108 as shown in FIGS. 6 and 7 is provided by way of example only and is not intended to limit the present subject matter in any aspect.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, the oven appliance defining a lateral direction and a transverse direction that are perpendicular to each other, the oven appliance comprising:

a cabinet that defines a cooking chamber for receipt of food items for cooking and an opening that permits access to the cooking chamber of said cabinet;

a pair of doors mounted to said cabinet at the opening of said cabinet, each door of said pair of doors having a vertically-oriented edge, the vertically-oriented edges of said pair of doors defining a gap therebetween when the doors of said pair of doors are in a closed position, each door of said pair of doors comprising an outer door panel; and an inner door panel spaced apart from said outer door panel in the lateral direction along at least one edge of the door such that said inner and outer door panels define a thermal break along the at least one edge;

a pair of flanges;

a first plurality of fasteners, each flange of said pair of flanges mounted to a respective inner door panel of said pair of doors at the vertically-oriented edges of said pair of doors with fasteners of said first plurality of fasteners, each fastener of said first plurality of fasteners extending along the transverse direction through a respective flange of said pair of flanges and the respective inner door panel of said pair of doors; and a second plurality of fasteners coupling each flange of said pair of flanges to a respective outer door panel of said pair of doors, each fastener of said second plurality of fasteners extending along the lateral direction through a respective flange of said pair of flanges and the respective outer door panel of said pair of doom each flange of said pair of flanges spaced apart from the respective outer door panel of said pair of doors along the lateral direction such that said flange does not touch said outer door panel.

2. The oven appliance of claim 1, wherein said outer and inner door panels are spaced apart from each other such that said inner and outer door panels do not touch each other along at least one edge of the door.

3. The oven appliance of claim 1, wherein said inner and outer door panels are constructed with metal.

4. The oven appliance of claim 1, wherein each fastener of said second plurality of fasteners comprises a first material and said inner door panels comprise a second material, said first material having a thermal conductivity less than that of the second material.

5. The oven appliance of claim 1, wherein each door of said pair of doors defines an inlet between said inner door panel and said outer door panel at the vertically-oriented edge of the door, the inlets configured for directing air from the gap into the thermal breaks of the pair of doors.

6. The oven appliance of claim 1, wherein each fastener of the second plurality of fasteners comprises a spacer that extends between one of said pair of flanges and the respective outer door panel of said pair of doors.

7. The oven appliance of claim 6, wherein the spacer comprises a ceramic grommet, a silicon grommet, a ceramic washer or a silicon washer.

8. An oven appliance, the oven appliance defining a lateral direction and a transverse direction that are perpendicular to each other, the oven appliance comprising:

a cabinet that defines a cooking chamber for receipt of food items for cooking and an opening for accessing the cooking chamber of said cabinet;

a pair of doors mounted to said cabinet at the opening of said cabinet, each door of said pair of doors having a vertically-oriented edge where the doors of said pair of doors meet when the doors of said pair of doors are in a closed position, each door of said pair of doors comprising an outer door panel; and an inner door panel spaced apart from said outer door panel at the vertically-oriented edge so as to define a thermal break therebetween;

a pair of flanges;

a first plurality of fasteners, each flange of said pair of flanges mounted to a respective inner door panel of said pair of doors at the vertically-oriented edges of said pair of doors with fasteners of said first plurality of fasteners, each fastener of said first plurality of fasteners extending along the transverse direction through a respective flange of said pair of flanges and the respective inner door panel of said pair of doors; and a second plurality of fasteners coupling each flange of said pair of flanges to a respective outer door panel of said pair of doors, each fastener of said second plurality of fasteners extending along the lateral direction through a respective flange of said pair of flanges and the respective outer door panel of said pair of doors, each flange of said pair of flanges spaced apart from the respective outer door panel of said pair of doors along the lateral direction such that said flange does not touch said outer door panel.

9. The oven appliance of claim 8, wherein said outer and inner door panels are spaced apart from each other such that said inner and outer door panels do not touch each other at the vertically-oriented edge.

10. The oven appliance of claim 8, wherein said inner and outer door panels are constructed with metal.

11. The oven appliance of claim 8, wherein each fastener of said second plurality of fasteners comprises a first material and said inner door panels comprise a second material, said first material having a thermal conductivity less than that of the second material.

12. The oven appliance of claim 8, wherein the vertically-oriented edges of said pair of doors define a gap therebetween when the doors of said pair of doors are in a closed position, each door of said pair of doors defining an inlet between the inner door panel and the outer door panel at the vertically-oriented edge, the inlets configured for directing air from the gap into the thermal breaks of the pair of doors.

13. The oven appliance of claim 8, wherein each fastener of the plurality of second fasteners comprises a spacer that extends between one of said pair of flanges and the respective outer door panel of said pair of doors.

14. The oven appliance of claim 13, wherein the spacer comprises a ceramic grommet, a silicon grommet, a ceramic washer or a silicon washer.

* * * * *